US007775769B1

(12) United States Patent
Liang

(10) Patent No.: US 7,775,769 B1
(45) Date of Patent: Aug. 17, 2010

(54) TURBINE AIRFOIL FILLET REGION COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 722 days.

(21) Appl. No.: 11/805,734

(22) Filed: May 24, 2007

(51) Int. Cl.
*F01D 5/08* (2006.01)

(52) U.S. Cl. ..... 416/97 R; 415/115

(58) Field of Classification Search ..... 415/115; 416/95, 97 R, 96 R
See application file for complete search history.

(56) References Cited

U.S. PATENT DOCUMENTS 5,340,278 A 8/1994 Magowan
5,488,825 A 2/1996 Davis et al.
5,813,836 A 9/1998 Starkweather
6,065,928 A 5/2000 Rieck, Jr. et al.
6,190,128 B1 * 2/2001 Fukuno et al. ..... 416/96 R
6,382,908 B1 5/2002 Keith et al.
6,478,540 B2 11/2002 Abuaf et al.
6,499,950 B2 * 12/2002 Willett et al. ..... 416/97 R
6,508,620 B2 1/2003 Sreekanth et al.
6,874,988 B2 4/2005 Tiemann
7,097,417 B2 * 8/2006 Liang ..... 415/115
7,217,096 B2 5/2007 Lee
7,220,103 B2 5/2007 Cunha et al.

* cited by examiner

*Primary Examiner*—Igor Kershteyn
(74) *Attorney, Agent, or Firm*—John Ryznic

(57) ABSTRACT

A stator vane with a serpentine flow cooling circuit having a first leg extending along the leading edge of the vane to supply compressed cooling air to the vane, and a last leg extending along the trailing edge of the vane and connected to a row of exit holes to discharge cooling air out through the trailing edge region of the vane. Inner diameter and outer diameter turn manifolds connect the adjacent legs of the serpentine flow circuit. A local impingement cavity is formed within the fillet region of the outer endwall of the trailing edge portion of the vane, and is connected to the outer diameter turn manifold by a metering hole to provide cooling air from the serpentine flow circuit into the local impingement cavity. A plurality of cooling holes are connected to the local impingement cavity and discharge cooling air out the endwall through holes that extend around the airfoil trailing edge from the suction side to the pressure side of the airfoil.

12 Claims, 5 Drawing Sheets

TURBINE AIRFOIL FILLET REGION COOLING

BACKGROUND OF THE INVENTION

1. Field of the Invention

The present invention relates generally to fluid reaction surfaces, and more specifically to a turbine vane with cooling of the fillet region.

2. Description of the Related Art Including Information Disclosed Under 37 CFR 1.97 and 1.98

In a gas turbine engine, especially an industrial gas turbine engine, a turbine section includes a plurality of stages of stator vanes and rotor blades to extract mechanical energy from the hot gas flow passing through the turbine. The efficiency of the turbine, and therefore of the engine, can be increased by increasing the turbine inlet temperature of the gas flow from the combustor. However, the temperature is limited to the material properties of the first stage turbine airfoils—the stator vanes and rotor blades —since the first stage airfoils are exposed to the hottest gas flow.

Passing cooling air through the airfoils can also allow for a higher gas flow temperature since the cooled airfoils can be exposed to higher temperatures. Complex convection and film cooling circuits have been proposed in the prior art to maximize the cooling effectiveness of the internal cooling circuits. Increasing the cooling ability while using less cooling air will provide higher efficiency. FIGS. 1 and 2 show one prior art vane cooling circuit which includes a 5-pass aft flowing serpentine cooling circuit, two ID (inner diameter) and OD (outer diameter) turns, skew trip strips for all of the serpentine cooling passages, cooling air feed through the airfoil leading edge passage from OD endwall, trailing edge discharge cooling slots, and a jumper tube for delivering cooling air to the inner seal housing, all of which provides for an efficient cooled turbine vane. See U.S. Pat. No. 5,488,825 issued to Davis et al on Feb. 6, 1996 and entitled GAS TURBINE VANE WITH ENHANCED COOLING, the entire disclosure being incorporated herein by reference. In the prior art FIG. 1 blade, the root and blade tip turns in the serpentine circuit take place within the airfoil between the endwalls of the vane.

However, the stator vane cooling circuit of FIGS. 1 and 2 has some disadvantages. For the vane trailing edge OD fillet region, due to inadequate cooling for the junction of the airfoil trailing edge fillet versus the endwall location, the vane aft fillet region experiences a low LCF (low cycle fatigue) life. Also, at the vane trailing edge fillet location, a higher heat transfer coefficient or heat load onto the downstream fillet location exists due to the trailing edge wake effect. On top of a higher heat load onto the airfoil fillet location due to the stress concentration issue, the cooling hole for the airfoil trailing edge OD section cannot be located high enough into the vane OD section fillet region to provide proper convective cooling. Cooling of this particular airfoil trailing edge fillet region becomes especially difficult.

It is therefore an object of the present invention to provide for a stator vane with improved cooling of the airfoil trailing edge fillet region.

It is another object of the present invention to provide for a turbine vane with an aft fillet region with an improved LCF life over the cited prior art reference.

BRIEF SUMMARY OF THE INVENTION

A turbine stator vane with a multiple pass serpentine flow cooling circuit with an OD turn along the trailing edge side of the airfoil. A metering hole connects the OD turn to a local impingement pocket located on the backside of the fillet and endwall of the airfoil. Cooling air from the serpentine turn is bled off through the metering hole for impingement cooling on the local impingement pocket. A plurality of trailing edge cooling holes connected to the local impingement cavity discharge cooling air around the airfoil fillet region for additional cooling.

DETAILED DESCRIPTION OF THE INVENTION

Figure 1:
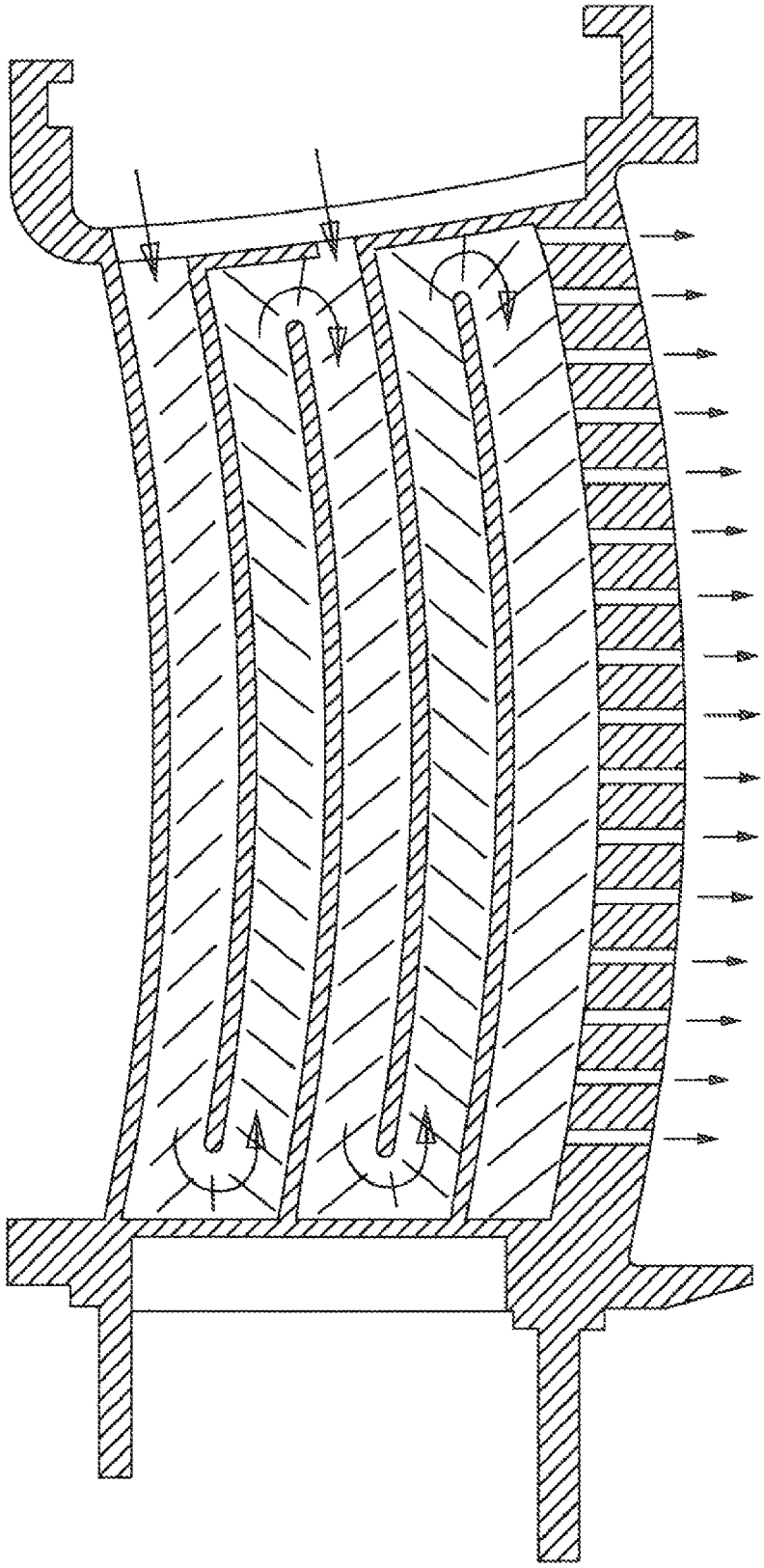
Fig 1 prior art
FIG. 1 shows cross section view of a cooling circuit in a prior art stator vane.
Figure 2:
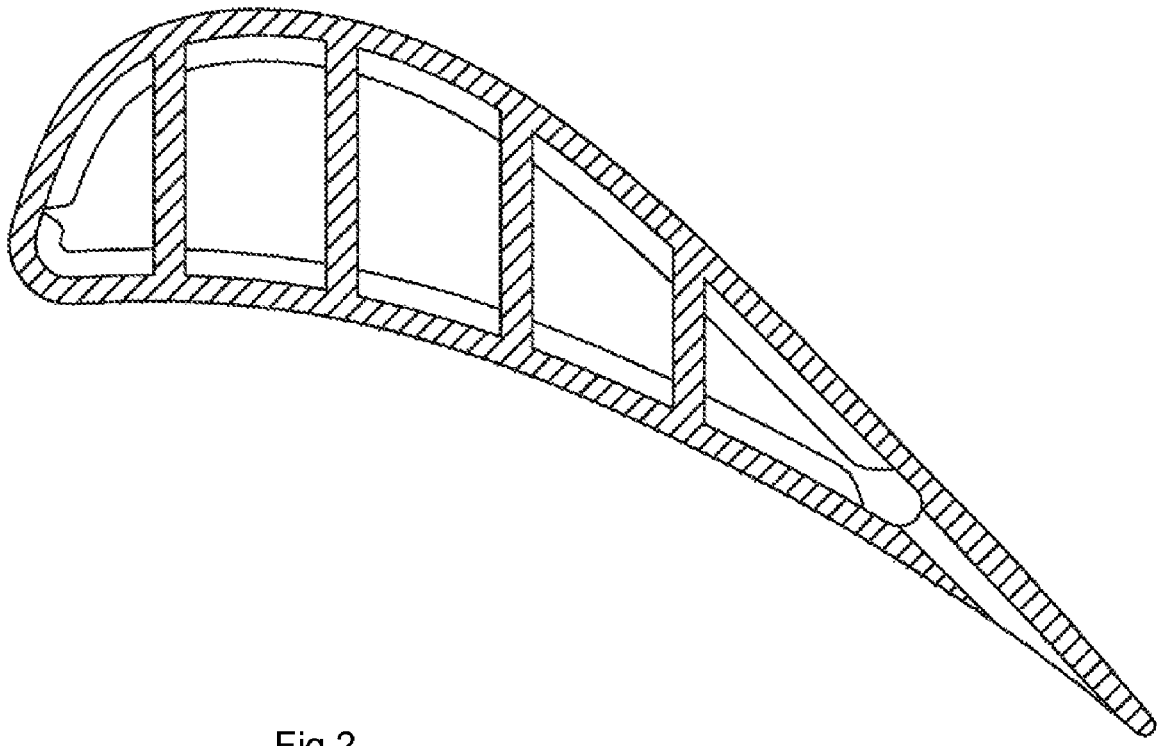
Fig 2 prior art
FIG. 2 shows a top cross sectional view of the prior art stator vane of FIG. 1.
Figure 3:
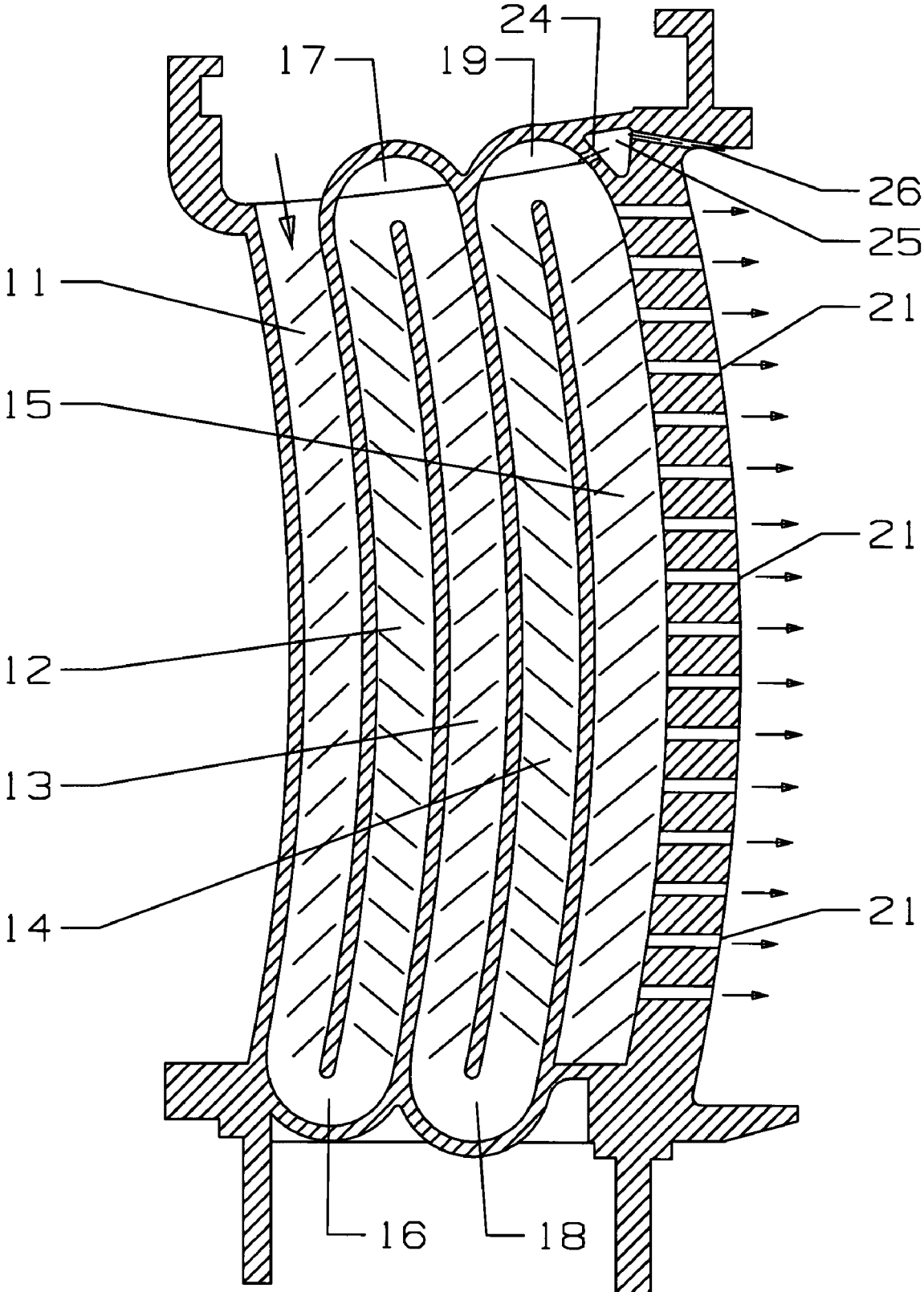
FIG. 3 shows a side cross sectional view of the stator vane cooling circuit of the present invention.
Figure 4:
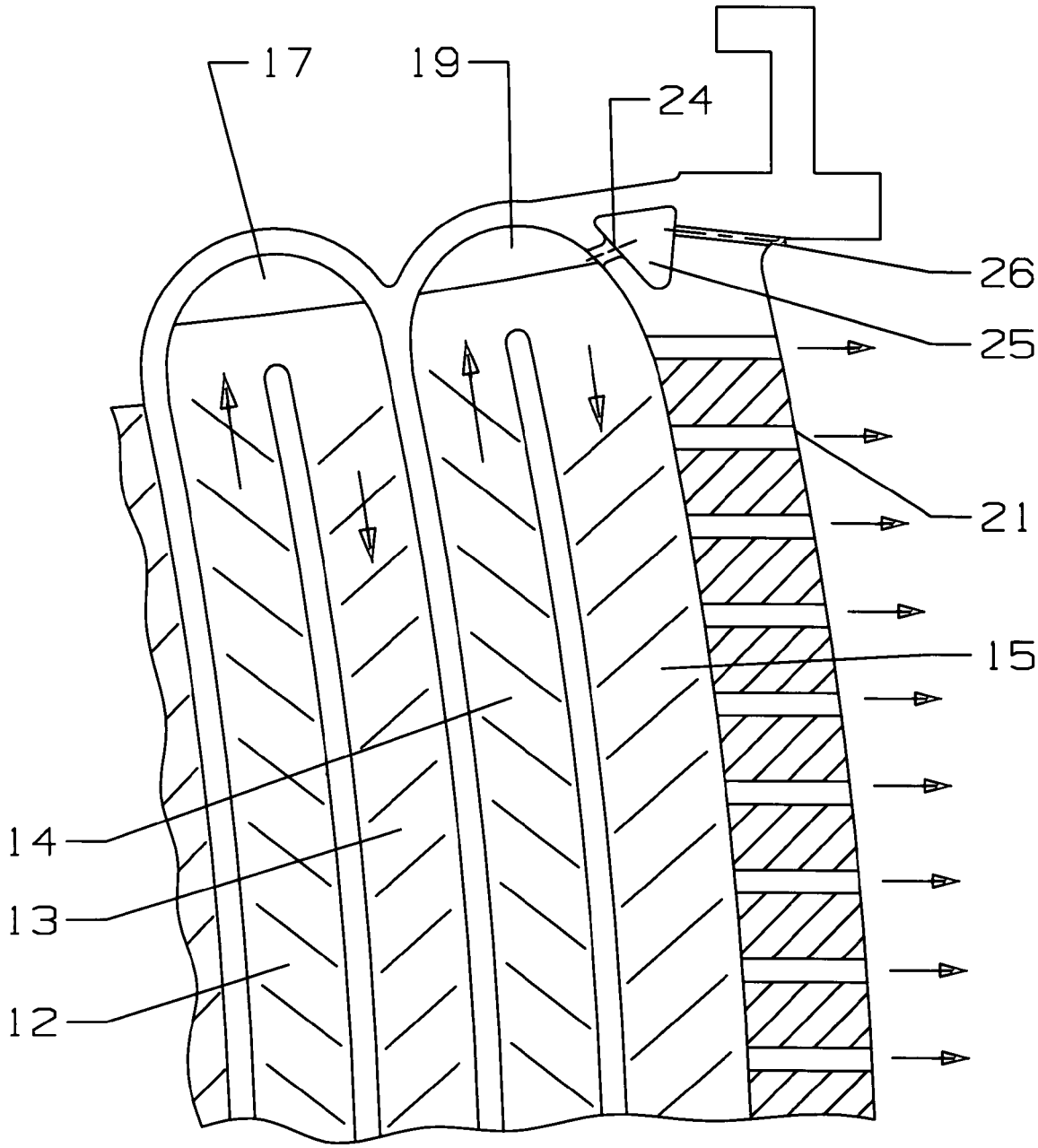
FIG. 4 shows a detailed view of the OD fillet region cooling circuit of the present invention from FIG. 3.
Figure 5:
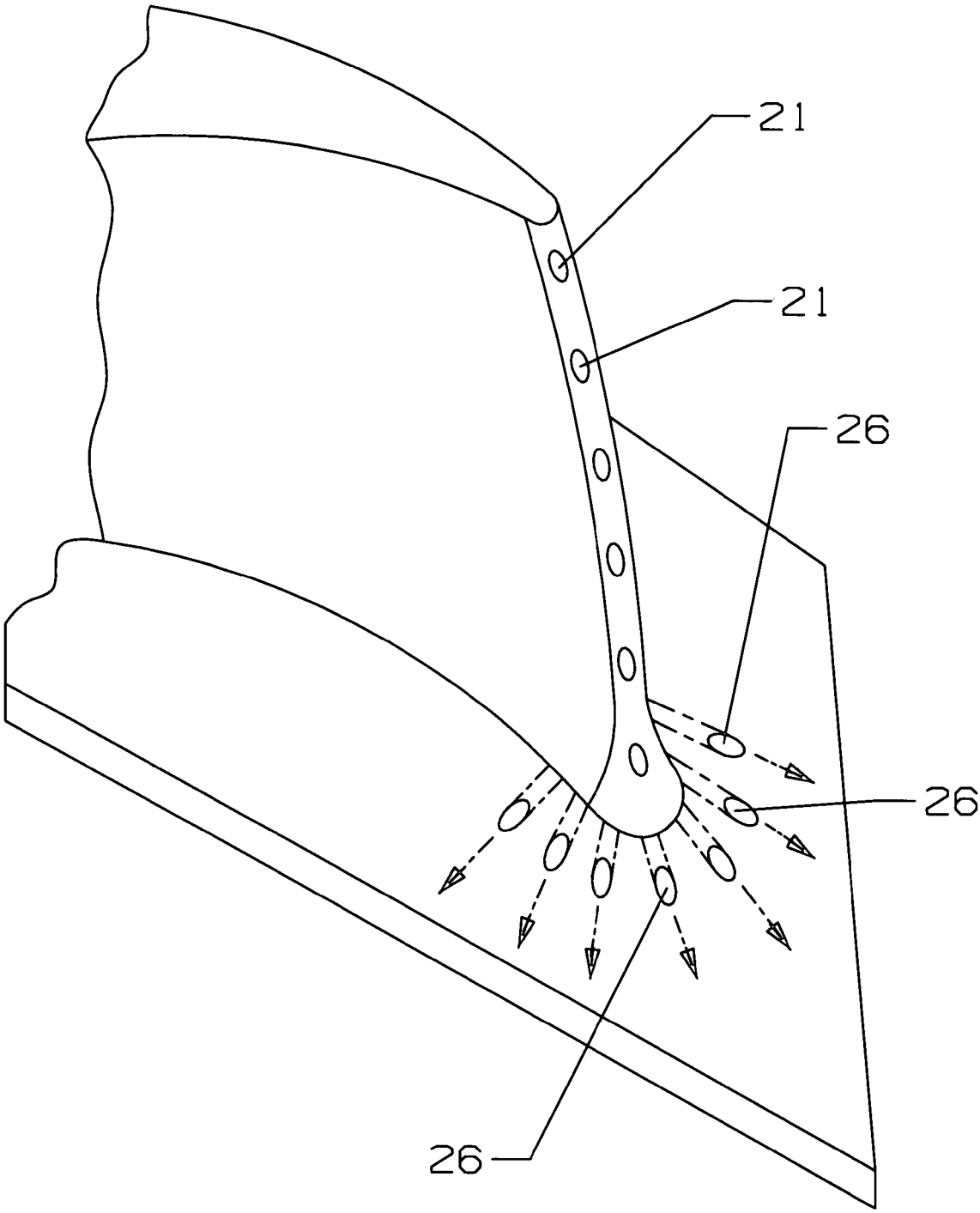
FIG. 5 shows a top view of the OD trailing edge fillet region cooling holes of the present invention.

The turbine stator vane with the fillet cooling circuit of the present invention is shown in FIGS. 3 through 5. FIG. 3 shows a cross section view of the vane used in an industrial gas turbine engine and includes a 5-pass serpentine flow cooling circuit with a leading edge supply channel or passage 11 located on the leading edge region of the vane, a second leg 12 of the serpentine circuit, a third leg 13, a fourth leg 14 and a fifth leg 15 located along the trailing edge region of the vane. Cooling air is supplied to the first leg passage 11 and flows in a serpentine path, passing around turns in the OD and the ID of the vane. A first ID turn manifold 16 on the ID shroud connects the first leg 11 to the second leg 12. A second ID turn manifold 18 connects the third leg 13 to the fourth leg 14. A first OD turn manifold 17 connects the second leg 12 to the third leg 13. A second OD turn manifold 19 connects the fourth leg 14 to the fifth and last leg 15. A row of exits holes or slots 21 is connected to the last leg of the serpentine circuit to discharge cooling air out through the trailing edge region of the vane. All of the legs of the serpentine flow circuit include trip strips to promote turbulent flow within the cooling air.

The last turn manifold in the OD 19 is also connected to a metering and impingement hole 24 to a local impingement pocket 25 formed in the OD turn location. FIG. 4 shows a detailed view of the last OD turn manifold 19 and the metering and impingement hole 24 connected to the local impingement cavity 25. A plurality of cooling holes 26 are located along the trailing edge fillet of the vane that open onto the airfoil surface as seen in FIG. 5. The cooling holes 26 are drilled from the airfoil OD endwall through below the fillet section into the impingement cavity 25 and around the fillet region. The metering hole 24 and the local impingement cavity 25 are both cast into the airfoil during the casting process that forms the vane. The cooling holes 26 are drilled after the vane has been cast.

Compressed cooling air supplied to the vane is passed into the first leg 11 extending along the leading edge of the vane. The cooling air then passes around the first ID turn manifold 16 and into the second leg 12, around the first OD turn manifold 17 and into the third leg 13, then around the second ID turn manifold 18 and into the fourth leg. The cooling air then passes from the fourth leg 14 into the second OD turn manifold 19 and into the fifth and last leg 15 extending along the trailing edge of the vane. Some of the cooling air passing into the second OD turn manifold 19 is bled off through the metering hole 24 and into the local impingement cavity 25. The metering hole 24 also functions as an impingement hole since the cooling air is both metered and impinged into the cavity 25 to provide impingement cooling on the backside of the fillet and the endwall location. The spent impingement cooling air is then discharged through a series of cooling holes 26. The OD turn manifold with the impingement pocket and cooling holes provide backside impingement for additional cooling of the airfoil OD endwall section versus fillet location which lowers the fillet region metal temperature and increases the airfoil low cycle fatigue (LCF) capability. The discharge cooling holes undercuts the airfoil fillet location, which softens the trailing edge stiffness and enhances the airfoil low cycle fatigue (LCF) capability. The spent cooling air that exits from the fillet peripheral cooling holes provide additional cooling for the vane trailing edge wake region cooling, and therefore lowers the fillet region thermal gradient and enhances the vane airfoil life.

I claim the following:

1. A stator vane for use in a gas turbine engine, the vane comprising:

an airfoil extending from an endwall;

a fillet formed between the airfoil and the endwall;

an internal cooling air circuit to pass cooling air through the vane;

a local impingement cavity located within the fillet region at a trailing edge region of the airfoil;

a metering hole connecting the internal cooling air circuit to the local impingement cavity; and, a plurality of cooling holes extending through the fillet region and connected to the local impingement cavity.

2. The stator vane of claim 1, and further comprising:

the metering hole is connected to an outer diameter turn manifold that forms part of a serpentine flow cooling circuit.

3. The stator vane of claim 2, and further comprising:

the metering hole is also an impingement cooling hole to provide backside impingement cooling to the local impingement cavity.

4. The stator vane of claim 1, and further comprising:

the plurality of cooling holes open onto the trailing edge endwall and extend around the trailing edge from the pressure side to the suction side of the airfoil.

5. The stator vane of claim 2, and further comprising:

a row of exit cooling holes extending along the trailing edge region of the airfoil and connected to a last leg of the serpentine flow cooling circuit.

6. The stator vane of claim 2, and further comprising:

the serpentine flow cooling circuit is a 5-pass serpentine flow circuit with the first leg extending along the leading edge region of the airfoil.

7. The stator vane of claim 6, and further comprising:

an outer diameter turn manifold connects the fourth and fifth legs of the serpentine flow circuit; and, the metering hole is connected to the outer diameter turn manifold.

8. The stator vane of claim 7, and further comprising:

the plurality of cooling holes open onto the trailing edge endwall and extend around the trailing edge from the pressure side to the suction side of the airfoil.

9. A process for cooling an airfoil trailing edge fillet region of a stator vane used in a gas turbine engine, the process comprising the steps of:

passing a compressed cooling air through a serpentine flow cooling circuit within the vane;

discharging cooling air from a last leg of the serpentine flow cooling circuit through a row of exit holes extending along the trailing edge region of the vane;

diverting a portion of the compressed cooling air from the serpentine flow cooling circuit through a metering hole and into a local impingement cavity; and, discharging the cooling air from the local impingement cavity through a plurality of cooling holes extending through the fillet region.

10. The process for cooling an airfoil trailing edge fillet region of a stator vane of claim 9, and further comprising the step of:

the step of metering the cooling air into the local impingement cavity also includes impinging the cooling air onto the backside of the local impingement cavity.

11. The process for cooling an airfoil trailing edge fillet region of a stator vane of claim 9, and further comprising the step of:

turning the compressed cooling air into the last leg of the serpentine flow cooling circuit in a turn manifold on the outer diameter and diverting the portion of cooling air from the turn manifold into the metering hole.

12. The process for cooling an airfoil trailing edge fillet region of a stator vane of claim 9, and further comprising the step of:

discharging the cooling air through the cooling holes extending around the trailing edge endwall region from the pressure side to the suction side of the airfoil.

* * * * *